US008116932B2

(12) United States Patent
Aldrich, III et al.

(10) Patent No.: US 8,116,932 B2
(45) Date of Patent: Feb. 14, 2012

(54) AUXILIARY PUMP DIAGNOSTIC SYSTEMS AND METHODS

(75) Inventors: William L. Aldrich, III, Davisburg, MI (US); Steven A. Tarnowsky, West Bloomfield, MI (US); Michael E. Polom, Oakland Township, MI (US); Roger Joseph Rademacher, Holt, MI (US); Donald D. Crites, Washington, MI (US); Keith D. Van Maanen, Birmingham, MI (US); Brian M Porto, Novi, MI (US); Michael Chernyak, Farmington Hills, MI (US)

(73) Assignee: GM Global Technology Operations LLC

( * ) Notice: Subject to any disclaimer, the term of this patent is extended or adjusted under 35 U.S.C. 154(b) by 381 days.

(21) Appl. No.: 12/392,411

(22) Filed: Feb. 25, 2009

(65) Prior Publication Data

US 2010/0217470 A1 Aug. 26, 2010

(51) Int. Cl.
*G01M 17/00* (2006.01)
*F04B 49/02* (2006.01)

(52) U.S. Cl. ..... 701/29; 701/31; 701/66; 417/24

(58) Field of Classification Search ..... 701/29, 701/31, 35, 33; 417/24, 476, 368; 180/242, 180/605, 44 M See application file for complete search history.

(56) References Cited

U.S. PATENT DOCUMENTS

| | | | | |
|---|---|---|---|---|
| 3,811,525 | A * | 5/1974 | Stuart | 180/243 |
| 7,520,354 | B2 * | 4/2009 | Morrow et al. | 180/65.31 |
| 7,522,979 | B2 * | 4/2009 | Pillar | 701/33 |
| 7,556,120 | B2 * | 7/2009 | Sah et al. | 180/305 |
| 7,643,924 | B2 * | 1/2010 | Kawamura et al. | 701/62 |
| 2003/0158640 | A1 * | 8/2003 | Pillar et al. | 701/33 |
| 2004/0073350 | A1 * | 4/2004 | Nagata et al. | 701/62 |
| 2006/0149433 | A1 * | 7/2006 | Otsubo et al. | 701/29 |
| 2008/0183352 | A1 * | 7/2008 | Mizobuchi et al. | 701/35 |
| 2010/0191402 | A1 * | 7/2010 | Aldrich et al. | 701/29 |
| 2010/0217470 | A1 * | 8/2010 | Aldrich et al. | 701/29 |
| 2011/0087397 | A1 * | 4/2011 | Iraha et al. | 701/29 |
| 2011/0112715 | A1 * | 5/2011 | Mundy et al. | 701/29 |

* cited by examiner

*Primary Examiner* — Ruth Ilan
*Assistant Examiner* — Karen A Beck

(57) ABSTRACT

A system includes an auxiliary pump that provides pressurized fluid to a transmission during an engine auto stop/start event. A mechanical pump provides pressurized fluid to a transmission during engine operation after the engine auto stop/start event. An auxiliary pump diagnostic system includes a slip determination module that determines slip of a torque converter based on an engine speed and a transmission input speed. A fault determination module diagnoses a fault in the auxiliary pump in response to an engine auto start and based on the slip of the torque converter.

19 Claims, 3 Drawing Sheets

AUXILIARY PUMP DIAGNOSTIC SYSTEMS AND METHODS

FIELD

The present disclosure relates to hybrid vehicles, and more particularly to auxiliary pump diagnostic systems and methods for hybrid transmissions.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A hybrid vehicle generally includes an engine and a motor generator to selectively provide torque to the transmission. The transmission transmits torque to a driveline. The hybrid configuration may be a belt alternator starter (BAS) system. The BAS system is characterized by a combined motor generator used in place of a standard alternator which is connected to the crankshaft of the engine via an accessory drive belt. The motor generator selectively provides positive torque to assist the engine or negative torque which adds a load to the engine. Assisting the engine draws electrical energy from a charge storage module, typically a battery. Adding load to the engine produces electrical energy which may be used to charge a charge storage module or feed the vehicle's electrical loads.

To reduce fuel consumption, the engine may be selectively stopped when the hybrid vehicle comes to a stop. This will be referred to as an auto-stop. During the auto-stop, the vehicle's electrical loads are provided by a charge storage module. The engine may restart when a driver lifts his/her foot off the brake pedal.

The gear selection of an automatic transmission of a hybrid vehicle is controlled by oil pressure in the transmission. The transmission includes a mechanical oil pump that applies appropriate hydraulic pressure for gear shifting. The transmission's mechanical oil pump is directly driven by the engine's crankshaft. When an engine auto-stop is commanded, for example only, when the vehicle stops for a stop light, the mechanical pump is disabled due to lack of power from the engine. An auxiliary transmission oil pump that is driven by an electric motor is enabled during the engine auto-stop. The auxiliary pump supplies oil to the transmission during the auto-stop to maintain a predetermined level of oil pressure in the transmission to maintain clutch pressure. Therefore, when the engine is ready for restart, the transmission is ready to transmit torque to the driveline. The auxiliary pump contributes to a smooth transition of torque to the driveline at engine restart. The auxiliary pump ensures that no undesired clutch slip occurs in the transmission during the engine restart.

SUMMARY

An auxiliary pump diagnostic system includes a slip determination module and a fault determination module. The slip determination module determines slip of a torque converter based on an engine speed and a transmission input speed. The fault determination module diagnoses a fault in an auxiliary pump based on the slip of the torque converter.

In other features, the auxiliary pump diagnostic system includes an enablement module that enables the fault determination module when the slip exceeds a first predetermined value after the engine auto-start is commanded and before a mechanical pump establishes a threshold pressure in the torque converter. The fault determination module diagnoses a fault in the auxiliary pump when a ratio of the slip to an engine speed is below a second predetermined value.

A method of diagnosing an auxiliary pump includes determining slip of a torque converter and diagnosing an auxiliary pump based on the slip. The diagnosis starts when the slip exceeds a first predetermined value.

Further areas of applicability of the present disclosure will become apparent from the detailed description provided hereinafter. It should be understood that the detailed description and specific examples, while indicating the preferred embodiment of the disclosure, are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
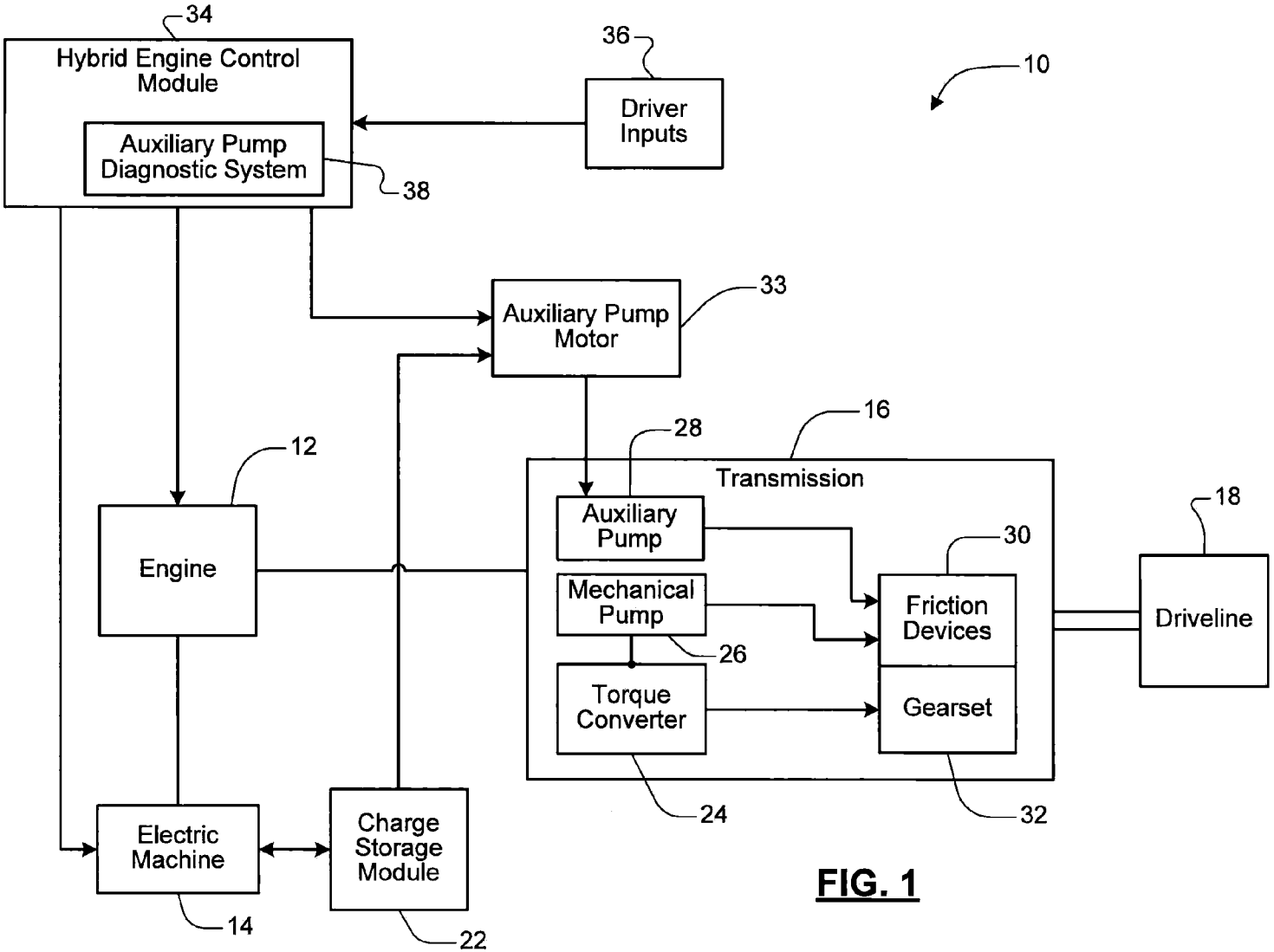
FIG. 1 is a functional block diagram of a hybrid powertrain of a vehicle that includes an auxiliary pump diagnostic system in accordance with the teachings of the present disclosure.

The following description is merely exemplary in nature and is in no way intended to limit the disclosure, its application, or uses. For purposes of clarity, the same reference numbers will be used in the drawings to identify similar elements. As used herein, the term "module" refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

An auxiliary pump diagnostic system in accordance with the teachings of the present disclosure determines slip of a torque converter based on an engine speed and a transmission input speed. The auxiliary pump diagnostic system diagnoses a fault in an auxiliary pump when a ratio of the slip to the engine speed is below a predetermined threshold during engine re-start.

Referring now to FIG. 1, an exemplary hybrid powertrain 10 includes an engine 12, an electric machine 14, a transmission 16, and a driveline 18. The electric machine 14 may convert power from the engine 12 into electrical power, which may be stored in a charge storage module 22. The electric machine 14 may also drive a crankshaft of the engine 12 to propel a vehicle when the engine 12 is not running. When the electric machine 14 is configured as a BAS, the electric machine 14 may be coupled to the engine 12 via a front end accessory drive belt.

The transmission 16 receives torque from the engine 12 and transmits the torque to the driveline 18. The transmission 16 may be an automatic transmission that changes gear ratios automatically. The transmission 16 is hydraulically operated and includes a torque converter 24, a mechanical pump 26, an auxiliary pump 28, friction devices 30, and a gear set 32. The torque converter 24 is a type of fluid coupling that is provided between the engine 12 and an input of the transmission 16. The torque converter 24 generally includes a pump connected to a crankshaft and a turbine connected to the input of the transmission 16. Auxiliary pump 28 may be a pump either internal or external to the transmission 16 and is driven by an auxiliary pump motor 33.

The torque converter 24 receives torque from the engine 12 and uses hydraulic (oil) pressure in the torque converter 24 to transmit the engine torque to the input of the transmission 16. The oil pressure is supplied by the mechanical pump 26 when the engine 12 is running or by the auxiliary pump 28 when the engine 12 is shut down. The torque at the input of the transmission 16 is transmitted via the torque converter 22 to the friction devices 30 in the transmission 16 to the gear set 32, which in turn, transmits torque to the driveline 18. The friction devices 30 require oil pressure to transmit torque and control which gear ratio is selected in the gear set 32.

For example only, the friction devices 30 may include clutches and/or bands and the gear set may be a planetary gear set. The friction devices 30 may control which components of the gear set are locked to each other, to a housing of the gear set, and/or to the input or the output of the gear set. This controls the gear ratio of the gear set.

The mechanical pump 26 is mechanically driven by the engine 12 to provide hydraulic pressure to the torque converter 24, the friction devices 30 and the gear set 32 when the engine 12 is running. The auxiliary pump 28 is electrically driven by the auxiliary pump motor 33 sourcing power from charge storage module 22, to supply oil pressure to the torque converter 24, the friction devices 30 and the gear set 32 during engine auto-stop and engine start.

When the engine 12 is running, the mechanical pump 26 which is directly coupled to the engine's 12 crankshaft provides oil pressure for the transmission 16. When the engine 12 stops, the mechanical pump 26 is disabled due to lack of power from the engine 12. The auxiliary pump 28 is enabled to supply oil pressure to the transmission 16 during engine auto-stop. As such, the friction devices 30 (for example only, clutch) and the torque converter 24 remain engaged, ready for engine restart. When the engine 12 restarts, the mechanical pump 26 is enabled. After the engine 12 reaches a certain RPM, the auxiliary pump 28 is deactivated because the mechanical pump 26 is capable of supplying oil pressure to the transmission 16.

The auxiliary pump 28 minimizes pressure dips that may occur when the oil pressure supply is transitioned from the auxiliary pump 28 to the mechanical pump 26. When the engine 12 stops and the mechanical pump 26 is disabled, a predetermined level of oil pressure is maintained in the hydraulic control circuits (not shown). Therefore, when the mechanical pump 26 is enabled, the mechanical pump 26 can more quickly build the required oil pressure for efficient gear shifting and acceleration without a significant delay.

A hybrid engine control module 34 controls the engine 12, the auxiliary pump motor 33 and the electric machine 14 based on driver inputs 36 and a plurality of sensors (not shown). The hybrid engine control module 34 includes an auxiliary pump diagnostic module 38 that diagnoses the ability of the auxiliary pump 28 to maintain oil pressure during the auto-stop. Diagnostic operation is performed during engine restart.

Figure 2:
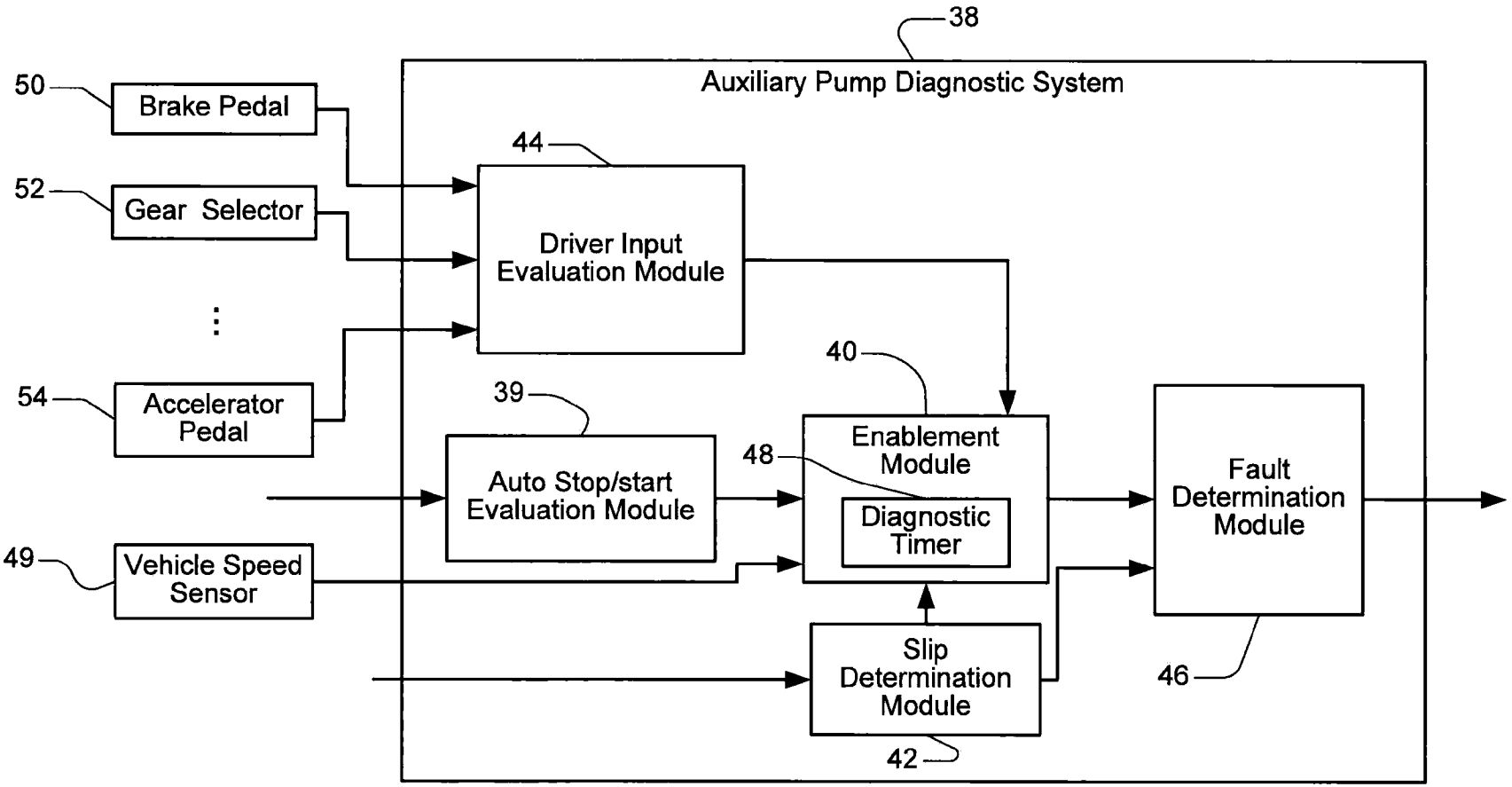
FIG. 2 is a functional block diagram of an auxiliary pump diagnostic system in accordance with the teachings of the present disclosure.

Referring to FIG. 2, the auxiliary pump diagnostic module 38 includes an auto stop/start evaluation module 39, an enablement module 40, a slip determination module 42, a driver input evaluation module 44, and a fault determination module 46.

The auto stop/start evaluation module 39 evaluates engine conditions and determines when an engine auto-start begins and the duration of the auto-stop preceding the auto-start. The auto stop/start evaluation module 39 generates and transmits a signal indicative of the engine auto-start status to the enablement module 40 when the brake pedal 50 is released. The slip determination module 42 calculates slip of the torque converter 24 based on the engine speed and the transmission input speed and generates a signal indicative of the slip value to the enablement module 40.

The enablement module 40 determines whether first enablement conditions are met to trigger a diagnostic timer 48 and whether a second enablement condition is met to activate the fault determination module 46. The enablement module 40 determines the first and second enablement conditions based on the signals from the auto stop/start evaluation module 39, the slip determination module 42, and a vehicle speed sensor 49. The first enablement conditions are met when the auto-start is commanded, when the duration of an auto-stop preceding the auto-start exceeds a first threshold time, and when the vehicle speed is zero. When the first enablement conditions are met, the enablement module 40 activates the diagnostic timer 48 to start measure the elapsed time after the auto-start is commanded. When the second enablement condition is present, the enablement module 40 enables the fault determination module 46. For example, the second enablement condition is present when the slip value exceeds a threshold within a predetermined time. For example only, the predetermined time may be one second after the auto-start is commanded.

The auxiliary pump diagnostic system 38 in accordance with the teachings of the present disclosure diagnoses the auxiliary pump 28 based on an ability of the torque converter 24 to apply torque to the transmission input immediately after an engine auto-start. The diagnosis is performed during a delay required by the mechanical pump 26 to create pressure in the transmission 16. Therefore, the auxiliary pump diagnostic system 38 performs diagnosis within the predetermined time period after the auto-start and before the mechanical pump 26 has run long enough (i.e., a threshold time) to pressurize the torque converter 24 and the friction devices 30 on its own.

Under normal operation of the torque converter 24, the output shaft (turbine shaft) of the torque converter 24 rotates slower than the input shaft (pump shaft) of the torque converter 24 by a factor referred to as "slip." The slip indicates the torque across the torque converter 24. Slip is defined as the speed difference between the pump shaft and the turbine shaft of the torque converter 24. The pump shaft is connected to the crankshaft of the engine 12. The turbine shaft is connected to the transmission input. Therefore, the slip can be defined as follows:

$$\begin{aligned}\text{Slip} &= (\text{Pump Speed} - \text{Turbine Speed})\\ &= (\text{Engine Speed} - \text{Transmission Input Speed})\end{aligned}$$

The second enablement condition is present when the slip exceeds a first predetermined value. During an auto-start, the initial acceleration of the crankshaft causes a measurable speed difference between the engine speed and the turbine speed due to the inertia of the turbine elements. The engine speed at this stage of the restart is too low to transmit significant torque to the friction device 30 (e.g., clutch elements). Therefore, this initial check of slip is used to ensure that during the auto-start, the engine speed increases at a rate sufficient to cause an observable inertia based slip signal. This initial check of slip ensures that a failed torque converter will not result in a misdiagnosis of the auxiliary pump 28. A failed torque converter with an impeller (the element of the torque converter which is driven at engine speed) locked to the turbine will not generate a slip that passes the diagnosis, which will be described below. Therefore, the initial check of the slip immediately after the auto-start ensures that the system acts as expected to accelerate the turbine and the transmission input regardless of oil pressure.

When the second enablement condition is met, the enablement module 40 activates the fault determination module 46. The fault determination module 46 records a sample count. The fault determination module 46 diagnoses the auxiliary pump 28 based on the slip, driver inputs, and engine speeds. The fault determination module 46 records a fail count when the torque converter slip falls below a predetermined percentage of the engine speed. In other words, when a ratio of the slip to the engine speed falls below a second predetermined value and when the driver input evaluation module 44 indicates no changed status of the driver inputs, the fault determination module 46 records a fail count. After a predetermined diagnostic time has elapsed, the fault determination module 46 evaluates the sample counts and the fail counts. When the sample counts reach a threshold and the ratio of fail counts to the sample counts exceeds another threshold, the fault determination module 46 diagnoses a fault in the auxiliary pump 28.

Acceleration of the engine 12 results in an indicated slip across the torque converter 24 (Slip=EngineSpeed−TurbineSpeed). The slip signal is inversely proportional to the magnitude of torque transmitted to the vehicle's driveline 18. When the slip is high, this indicates that little of the engine's torque is transmitted to the vehicle driveline 18. The high slip condition is indicative of low oil pressure and the concomitant inability of the friction devices 30 to transmit torque. When slip is low, this indicates that the friction devices 30 are directly transferring the engine torque directly to the driveline 18 and consequently must be properly pressurized. When the slip excels a predetermined percentage of the engine speed (for example, a second threshold), it can be determined that the transmission is unable to transmit engine torque due to low oil pressure. Therefore, the ratio of the slip to the engine speed gives an indication of whether the auxiliary pump provided adequate pressure during the auto-stop.

The driver input evaluation module 44 communicates with a plurality of driver input devices that include, but are not limited to, a brake pedal 50, a gear selector 52 and an accelerator pedal 54. The driver input evaluation module 44 identifies conditions that may affect the slip of the torque converter 24 during engine start, which may cause a false diagnosis.

In some situations, a changed status of the driver input devices may result in a signal profile (or slip profile) that corresponds to a failed pump. For example only, a false diagnosis may occur when the gear selector 52 is shifted (particularly to a Neutral position) during diagnosis. In this situation, the transmission 16 may be commanded to transmit less torque or no torque to the driveline 18. Therefore, the ratio of the slip to the engine speed may not exceed the second predetermined value, resulting in a slip profile that corresponds to a failed pump.

A false diagnosis may occur when the vehicle is directed downhill during engine auto-start and the vehicle may accelerate with little torque transmitted across the torque converter. In this situation, the engine speed increases relatively fast with little torque transmitted from the engine 12 to the transmission 16. The ratio of the slip to the engine speed may not exceed the second predetermined value during diagnosis, resulting in a slip profile that corresponds to a failed auxiliary pump.

Therefore, the driver input evaluation module 44 evaluates the status of the driver input devices and determines whether the driver input devices are changed during diagnosis to adversely affect an accurate diagnosis. The driver input evaluation module 44 also monitors the vehicle speed. Upon identifying a situation that may affect an accurate diagnosis (for example only, changed status of driver input devices or vehicle speed increasing too fast), the driver input evaluation module 44 sends a signal to the enablement module 40. The signal from the driver input evaluation module 44 indicates that vehicle conditions are incorrect for accurate diagnosis. In response to the signal from the driver input evaluation module 44, the enablement module 40 aborts the diagnosis and discards the diagnostic data. If no signal indicative of incorrect vehicle conditions is received from the driver input evaluation module 44, the enablement module 40 activates the fault determination module 46 to continue to diagnose the operation of the auxiliary pump 28.

Figure 3:
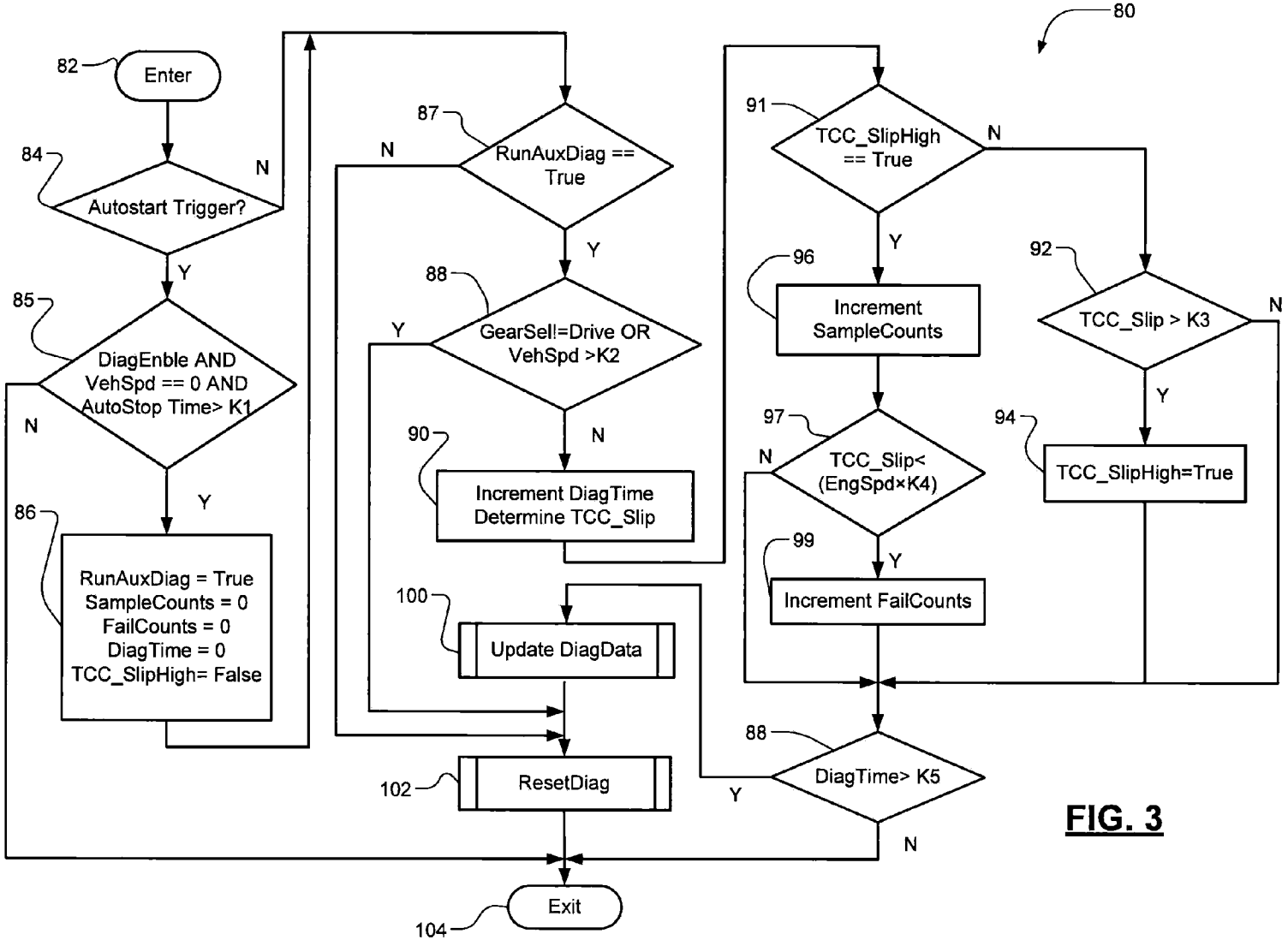
FIG. 3 is a flow diagram of a method of diagnosing an auxiliary pump in accordance with the teachings of the present disclosure.

Referring now to FIG. 3, a method 80 of diagnosing an auxiliary pump starts in step 82. Step 82 is executed at a periodic rate sufficient to satisfy the diagnostic's accuracy requirements. For exemplary purposes, this rate may be every 25 milliseconds. The auto stop/start evaluation module 39 determines when and whether an auto-start trigger has been issued in step 84. When an auto-start trigger is not commanded in step 84, the method 80 proceeds to step 87, which will be described below. When an auto-start trigger is commanded in step 84, the method 80 proceeds to step 85. The path from step 84 to 85 will only be taken once per auto start event.

In step 86, the enablement module 40 determines whether the first enablement conditions are met to trigger the diagnostic timer 48. The first enablement conditions are met when vehicle speed is zero and when the auto stop preceding the auto start was active for a period of time greater than a first threshold K1. These requirements ensure that the auxiliary pump 28 has been enabled long enough to merit diagnosis. If both conditions are valid, a diagnostic timer 48 is initialized, along with additional variables used to monitor the diagnostic progress in step 88. If the enablement conditions are not met in step 85, the method 80 proceeds to step 104 and ends.

In step 87, a check is made to determine if the diagnostic has been enabled in step 86. If the diagnostic has been enabled in step 87, the driver input evaluation module 44 determines whether the driver input status has changed or the vehicle speed increases at a rate faster than a threshold rate K2 during diagnosis in step 88. If the driver input status is not changed and the vehicle speed does not increase at a rate faster than the threshold rate K2, the diagnostic timer 48 increments the diagnostic time and the slip determination module 42 determines a slip of the torque converter ("TCC_Slip") in step 90. Otherwise, the enablement module 40 aborts the diagnosis and resets the diagnostic data in step 102.

The enablement module 40 determines whether the TCC_Slip has been high (i.e., whether the TCC_Slip has been exceeding a third threshold K3) in step 91. If the TCC_Slip has been high in step 91, the second enablement condition is met. Therefore, the fault determination module 46 is activated to increment sample counts in step 96. If the TCC_Slip has not been high in step 91, the enablement module 40 determines whether the TCC_Slip exceeds the third threshold K3 in step 92. If TCC_Slip exceeds the third threshold K3 in step 92, the enablement module 40 activates the fault determination module 46 and updates the diagnostic variables in step 94. The method 80 then proceeds to step 88 where the diagnostic timer 48 is checked. If the diagnostic timer 48 records a diagnostic time that is less than the fifth threshold K5, the method 80 proceeds to step 104. If the diagnostic timer is greater than the fifth threshold K5 in step 88, the fault determination module 46 evaluates the diagnostic data in step 100.

Returning to step 91, when the TCC_Slip has been high in step 91, all conditions to enable diagnosis of auxiliary pump 28 have been satisfied. In step 96, the fault determination module 46 increments the sample counts in step 96. Each sample count represents a check of the slip criteria (i.e., all enablement conditions are met for an accurate diagnosis). Step 96 proceeds to step 97. The fault determination module 46 determines whether a ratio of the slip to the engine speed is below a fourth threshold K4 in step 97. If the ratio of the slip to the engine speed is below the fourth threshold K4, the fault determination module 46 increments a fail count in step 99. If the ratio of the slip to the engine speed is above the fourth threshold K4 in step 97, the method 80 proceeds to step 88. As previously set forth, when the diagnostic time exceeds the fifth threshold K5 in step 88, the fault determination module 46 evaluates the logged diagnostic data to determine whether the auxiliary pump fails in step 100. The logged diagnostic data include the logged sample counts and fail counts.

The fault determination module 46 records and evaluates data regarding sample counts and fail counts. If the sample counts are greater than a sixth threshold and the ratio of fail counts to the sample counts exceeds a seventh threshold, the fault determination module 46 diagnoses a fault in the auxiliary pump. Otherwise, the diagnostic is passed. The method 80 then proceeds to step 102 to reset the diagnostic variables in preparation for the next auto start event. The method 80 ends in step 104.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A system comprising:

an auxiliary pump that provides pressurized fluid to a transmission during an engine auto stop/start event;

a mechanical pump that provides pressurized fluid to a transmission during engine operation after the engine auto stop/start event; and an auxiliary pump diagnostic system including:

a slip determination module that determines slip of a torque converter based on an engine speed and a transmission input speed; and a fault determination module that diagnoses a fault in the auxiliary pump in response to an engine auto start and based on the slip of the torque converter.

2. The system of claim 1 further comprising an enablement module that enables the fault determination module after an engine auto-start and before the mechanical pump establishes a threshold pressure in the torque converter.

3. The system of claim 2 wherein the enablement module enables the fault determination module when the slip of the torque converter exceeds a first predetermined value.

4. The system of claim 3 wherein the fault determination module records a sample count when the slip of the torque converter exceeds the first predetermined value.

5. The system of claim 4 wherein the fault determination module records a fail count when a ratio of the slip to an engine speed is below a second predetermined value.

6. The system of claim 5 wherein the fault determination module diagnoses a fault in the auxiliary pump when the sample count reaches a third predetermined value and a ratio of the fail count to the sample count exceeds a fourth predetermined value.

7. The system of claim 1 further comprising a driver input evaluation module that determines a status of driver input devices.

8. The system of claim 7 wherein a diagnosis is aborted when the driver input evaluation module determines a changed status of driver input devices.

9. The system of claim 8 wherein the changed status includes shifting of a drive selector.

10. The system of claim 8 wherein the changed status includes a vehicle speed increase exceeding a second threshold rate.

11. A method comprising:

operating an auxiliary pump to provide pressurized fluid to a transmission during an engine auto stop/start event;

operating a mechanical pump to provide pressurized fluid to a transmission during engine operation after the engine auto stop/start event; and diagnosing the auxiliary pump by:

determining slip of a torque converter; and diagnosing the auxiliary pump in response to an engine auto start and based on the slip.

12. The method of claim 11 further comprising starting a diagnosis within a predetermined time period after engine auto-start and before the mechanical pump establishes a threshold pressure in the torque converter.

13. The method of claim 11 further comprising starting a diagnosis when the slip of the torque converter exceeds a first predetermined value.

14. The method of claim 13 further comprising recording a sample count when the slip of the torque converter exceeds the first predetermined value.

15. The method of claim 14 further comprising recording a fail count when a ratio of the slip to an engine speed is below a second predetermined value.

16. The method of claim 15 further comprising diagnosing a fault in the auxiliary pump when the sample count reaches a third predetermined value and a ratio of the fail count to the sample count exceeds a fourth predetermined value.

17. The method of claim 11 further comprising aborting the diagnosing when a changed status of driver input devices is detected.

18. The method of claim 17 wherein the changed status of driver input devices includes shifting of a gear selector.

19. The method of claim 11 further comprising aborting the diagnosing when a vehicle speed increases at a rate exceeding a threshold.

* * * * *